US008469190B1

(12) United States Patent
Chang

(10) Patent No.: US 8,469,190 B1
(45) Date of Patent: Jun. 25, 2013

(54) TOOL BOX

(75) Inventor: Jason Chang, Taichung (TW)

(73) Assignee: Primaplus Industrial Co., Ltd., Taichung (TW)

( * ) Notice: Subject to any disclaimer, the term of this patent is extended or adjusted under 35 U.S.C. 154(b) by 0 days.

(21) Appl. No.: 13/423,323

(22) Filed: Mar. 19, 2012

(51) Int. Cl.
*B65D 85/28* (2006.01)

(52) U.S. Cl.
USPC ..... 206/372; 206/375

(58) Field of Classification Search
USPC ..... 206/372–379, 349; 211/70.6; 220/810, 220/817, 825, 827, 830
See application file for complete search history.

(56) References Cited

U.S. PATENT DOCUMENTS

| | | | | |
|---|---|---|---|---|
| 5,512,165 | A * | 4/1996 | Liu | 206/234 |
| 6,405,865 | B1 * | 6/2002 | Lin | 206/379 |
| 6,978,890 | B2 * | 12/2005 | Pangerc et al. | 206/349 |
| 6,988,616 | B2 * | 1/2006 | Chen | 206/379 |
| D516,812 | S * | 3/2006 | Pangerc et al. | D3/294 |
| 7,032,483 | B2 * | 4/2006 | Liu | 81/490 |
| 7,168,559 | B2 * | 1/2007 | Chen | 206/373 |
| D537,253 | S * | 2/2007 | Chen | D3/315 |
| 7,360,654 | B2 * | 4/2008 | Liu | 206/754 |
| 7,434,688 | B2 * | 10/2008 | Hu | 206/377 |
| 7,624,863 | B2 * | 12/2009 | Meng | 206/349 |
| 7,661,526 | B2 * | 2/2010 | Lin | 206/379 |
| 7,677,391 | B2 * | 3/2010 | Pistor et al. | 206/379 |
| 7,770,727 | B2 * | 8/2010 | Meng | 206/373 |
| 8,038,004 | B2 * | 10/2011 | Hu | 206/375 |
| 8,083,060 | B1 * | 12/2011 | Liu | 206/379 |
| 8,186,510 | B1 * | 5/2012 | Chen | 206/375 |
| 8,302,771 | B2 * | 11/2012 | Arslan | 206/372 |
| 8,317,021 | B2 * | 11/2012 | Christopher | 206/375 |

* cited by examiner

*Primary Examiner* — J. Gregory Pickett
*Assistant Examiner* — Ernesto Grano
(74) *Attorney, Agent, or Firm* — Alan Kamrath; Kamrath IP Lawfirm, P.A.

(57) ABSTRACT

A tool box includes a main body, a mounting seat pivotally mounted on the main body for mounting a hand tool, a positioning member movably mounted in the main body and releasably locked onto the mounting seat, and at least one tool holder pivotally mounted on the main body for mounting a plurality of tool heads. The main body includes an upper shell and a lower shell. The upper shell has a mounting hole for mounting a control knob. The tool holder has a mounting sleeve for mounting a push button. Thus, the user only needs to press the control knob and the push button to pivot the mounting seat and the tool holder respectively so that the mounting seat and the tool holder can be opened easily and quickly.

7 Claims, 6 Drawing Sheets

TOOL BOX

BACKGROUND OF THE INVENTION

1. Field of the Invention

The present invention relates to a box and, more particularly, to a tool box for storing hand tools, such as screwdriver tips, drill bits, screws, bolts and the like.

2. Description of the Related Art

A conventional tool box comprises a shell and a cover pivotally connected with the shell. The shell contains a plurality of recesses or slots for receiving multiple hand tools (a handle, a connecting shank and the like) and multiple tool heads (screwdriver tips, drill bits and the like). However, the hand tools and the tool heads are fixed in the shell and cannot be pivoted and exposed outward from the shell automatically so that the user cannot remove the hand tools and the tool heads from the shell easily and quickly.

BRIEF SUMMARY OF THE INVENTION

In accordance with the present invention, there is provided a tool box, comprising a main body, a mounting seat pivotally mounted on the main body for mounting a hand tool, a positioning member movably mounted in the main body and releasably locked onto the mounting seat, and at least one tool holder pivotally mounted on the main body for mounting a plurality of tool heads.

The main body includes an upper shell and a lower shell combined with the upper shell. The upper shell of the main body has a surface provided with an exposing slot. The upper shell of the main body has a mounting hole for mounting a control knob and a first compression spring. The control knob is movably mounted in the mounting hole of the upper shell and has an upper end protruding outward from the mounting hole of the upper shell and a lower end provided with an oblique push block. The upper shell of the main body has a side provided with at least one first limit recess which has at least one first locking groove, and the lower shell of the main body has a side provided with at least one second limit recess which has at least one second locking groove. The mounting seat has a first end provided with at least one pivot shaft pivotally mounted between the upper shell and the lower shell of the main body and a second end provided with a mounting recess for mounting the hand tool. The mounting seat is provided with at least one positioning stub and a first torsion spring. The positioning member has a first end provided with at least one pressing piece pressing the oblique push block of the control knob and a second end provided with a second compression spring which is biased between the positioning member and the lower shell of the main body. The positioning member has a mediate portion provided with at least one locking hook detachably locked onto the positioning stub of the mounting seat. The tool holder has a side provided with a plurality of receiving slots to allow insertion of the tool heads. The tool holder has a first end provided with a second torsion spring and a second end provided with a mounting sleeve for mounting a push button and a third compression spring. The push button is provided with at least one locking piece detachably locked between the first locking groove of the first limit recess of the upper shell and the second locking groove of the second limit recess of the lower shell.

The primary objective of the present invention is to provide a tool box that is opened easily and quickly in an automatic manner.

According to the primary advantage of the present invention, the mounting seat and the tool holder can be pivoted outward automatically to expose the hand tool and the tool heads respectively so that the tool heads can co-operate with the hand tool for use with the user.

According to another advantage of the present invention, the user only needs to press the control knob and the push button to pivot the mounting seat and the tool holder respectively so that the mounting seat and the tool holder can be opened easily and quickly, thereby facilitating the user operating the tool box.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

Figures 2, 2A:
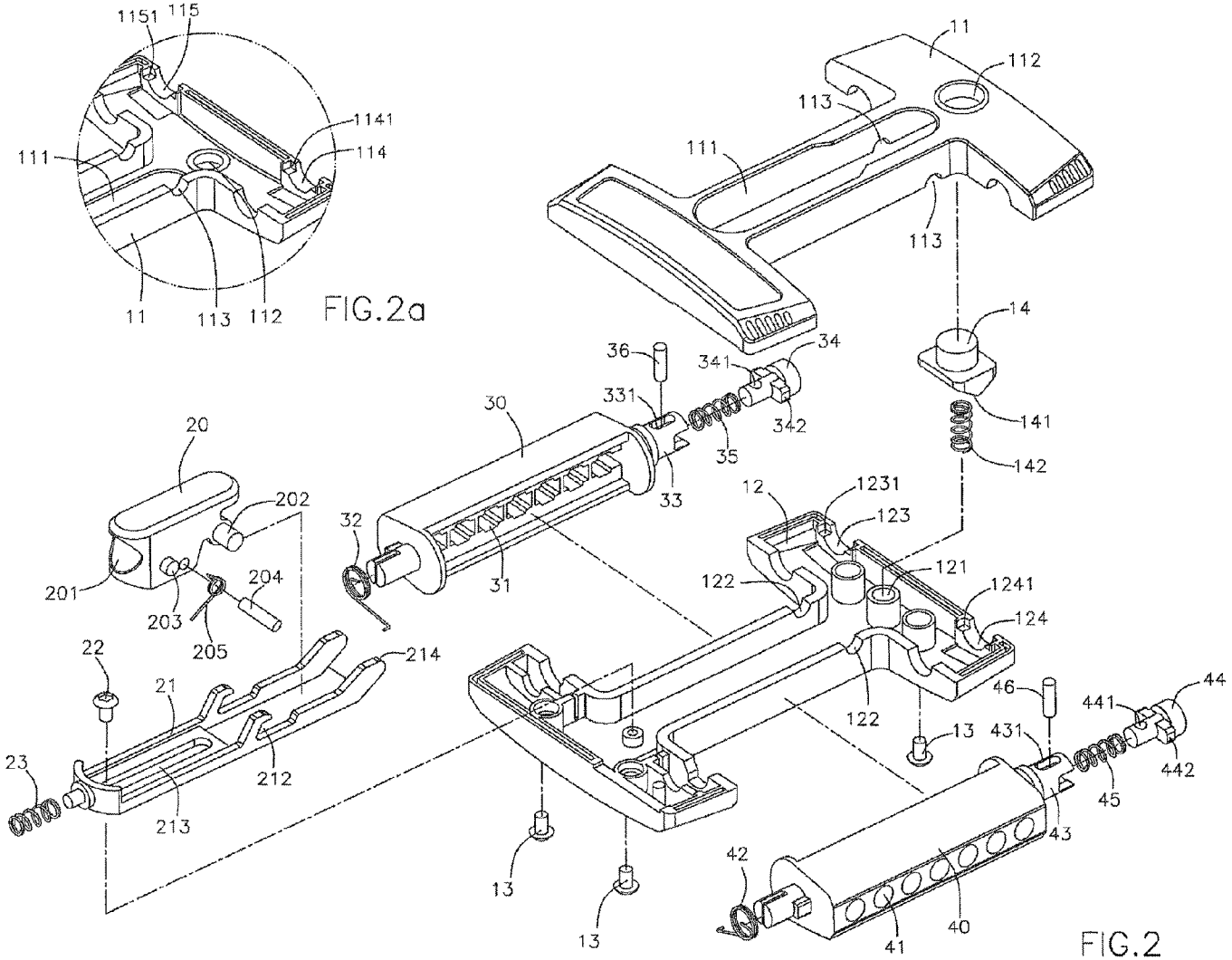
FIG. 2 is an exploded perspective view of the tool box as shown in FIG. 1.

FIG. 2*a* is a bottom perspective view of an upper shell of the tool box as shown in FIG. 2.

Figure 1:
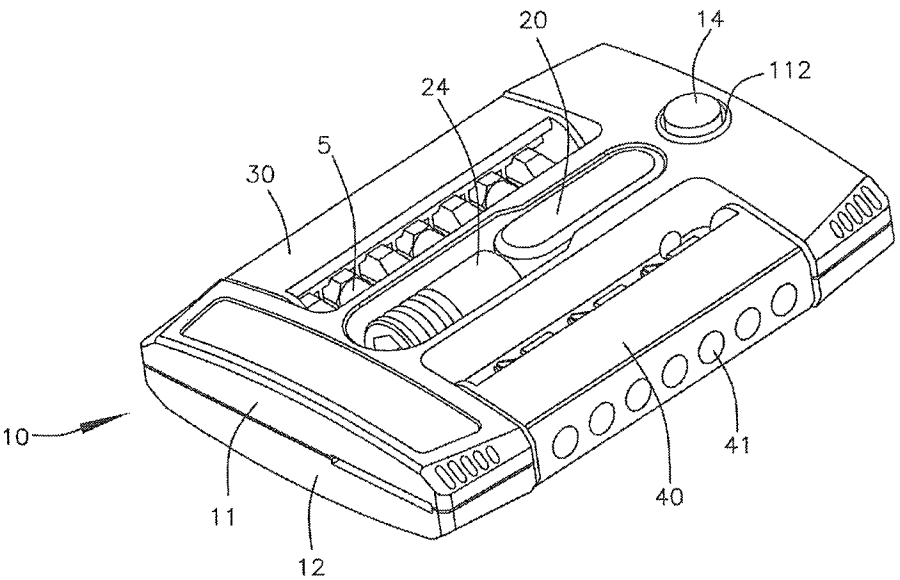
FIG. 1 is a perspective view of a tool box in accordance with the preferred embodiment of the present invention.
Figure 3:
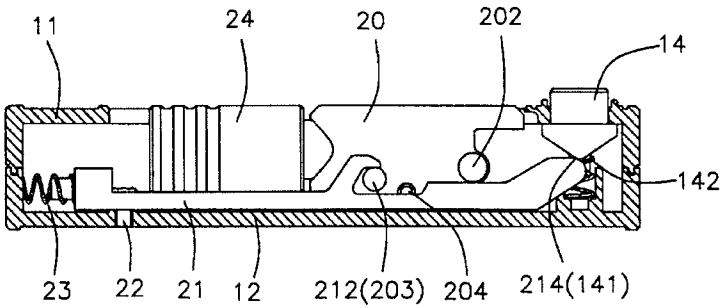

FIG. 3 is a front cross-sectional view of the tool box as shown in FIG. 1.

Figure 4:
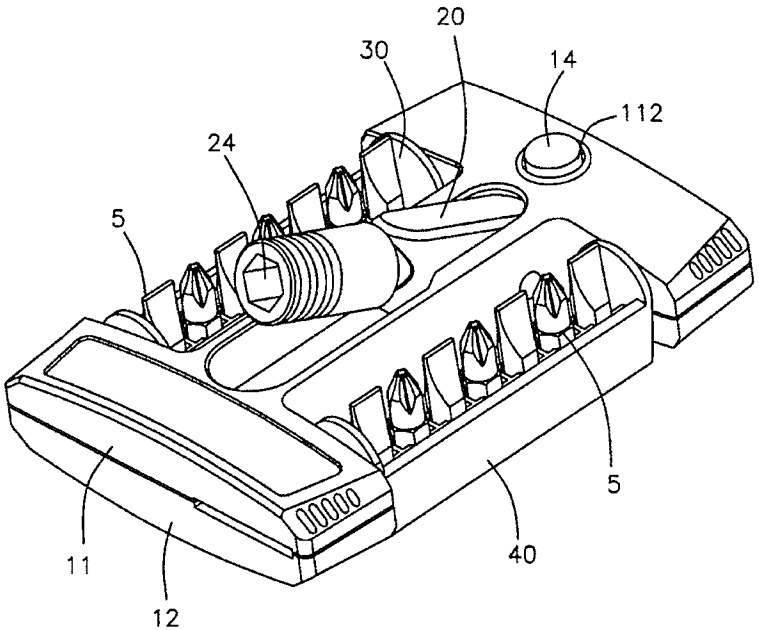

FIG. 4 is a schematic operational view of the tool box as shown in FIG. 1 in use.

Figure 5:
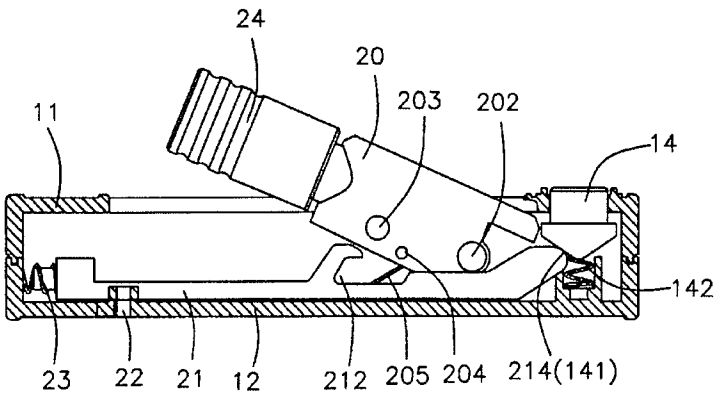

FIG. 5 is a schematic operational view of the tool box as shown in FIG. 3.

Figure 6:
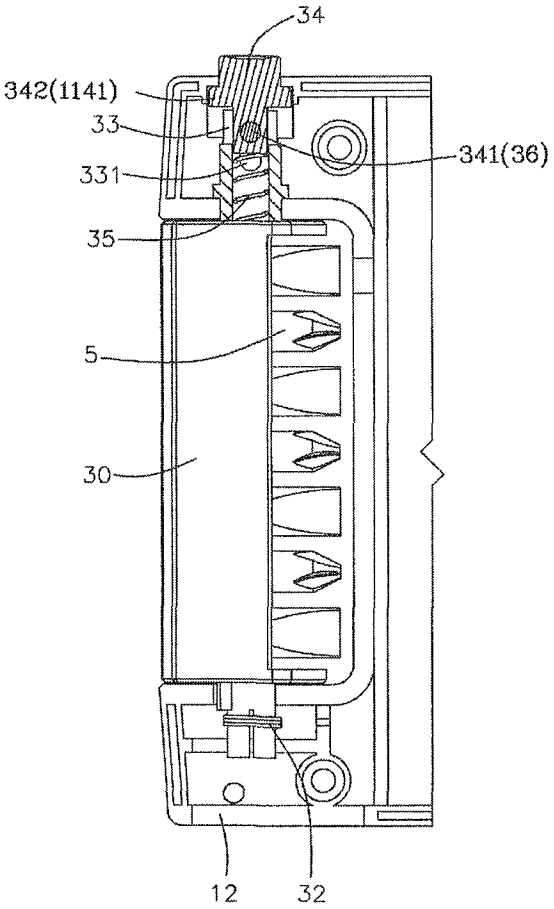

FIG. 6 is a top cross-sectional view of the tool box as shown in FIG. 1.

Figure 7:
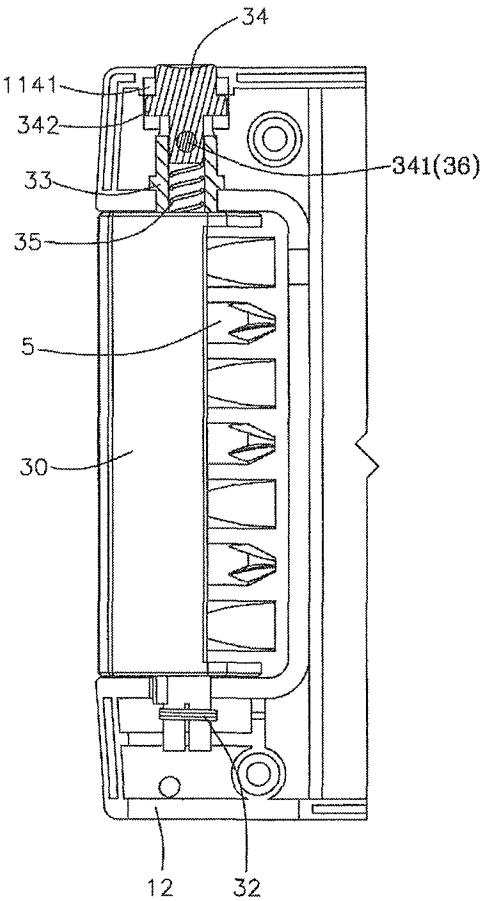

FIG. 7 is a schematic operational view of the tool box as shown in FIG. 6.

Figure 8:
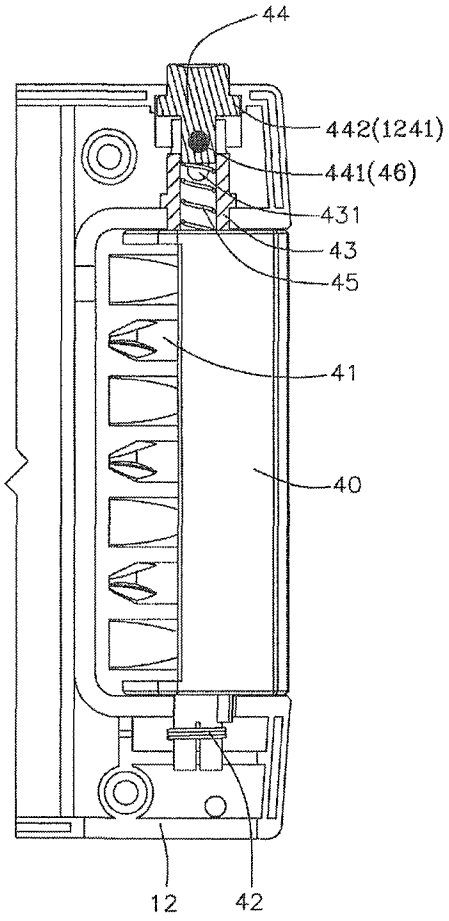

FIG. 8 is another top cross-sectional view of the tool box as shown in FIG. 1.

Figure 9:
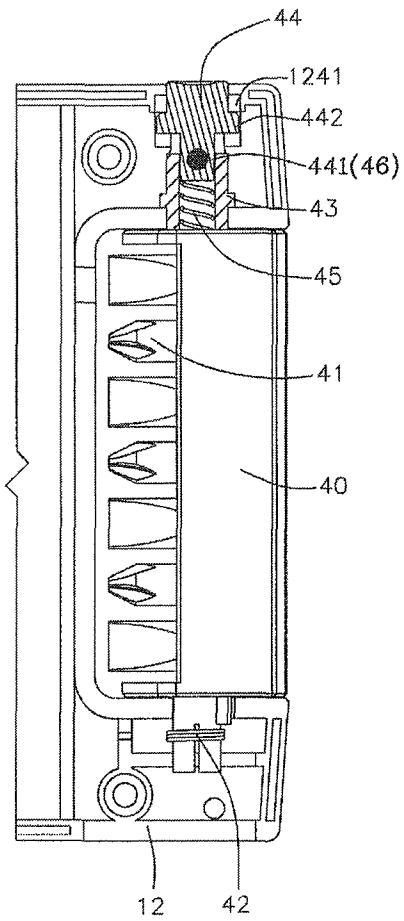

FIG. 9 is a schematic operational view of the tool box as shown in FIG. 8.

DETAILED DESCRIPTION OF THE INVENTION

Referring to the drawings and initially to FIGS. 1-3, a tool box in accordance with the preferred embodiment of the present invention comprises a main body 10, a mounting seat 20 pivotally mounted on the main body 10 for mounting a hand tool 24, a positioning member 21 movably mounted in the main body 10 and releasably locked onto the mounting seat 20, and at least one tool holder 30 or 40 pivotally mounted on the main body 10 for mounting a plurality of tool heads 5.

The main body 10 has a substantially I-shaped profile. The main body 10 includes an upper shell 11 and a lower shell 12 combined with the upper shell 11 by a plurality of fastening members 13. The upper shell 11 of the main body 10 has a surface provided with an exposing slot 111. The upper shell 11 of the main body 10 has a mounting hole 112 for mounting a control knob 14 and a first compression spring 142. The control knob 14 is movably mounted in the mounting hole 112 of the upper shell 11 and has an upper end protruding outward from the mounting hole 112 of the upper shell 11 and a lower end provided with an oblique push block 141. The first compression spring 142 is biased between the oblique push block 141 of the control knob 14 and the lower shell 12 of the main body 10. The upper shell 11 of the main body 10 has a side provided with at least one first limit recess 114 or 115 (see FIG. 2*a*) which has at least one first locking groove 1141 or 1151, and the lower shell 12 of the main body 10 has a side provided with at least one second limit recess 123 or 124 which has at least one second locking groove 1231 or 1241. The upper shell 11 of the main body 10 has an edge provided with at least one first pivot recess 113, and the lower shell 12 of the main body 10 has an edge provided with at least one second pivot recess 122. The lower shell 12 of the main body 10 has a surface provided with a mounting tube 121 for mounting the first compression spring 142.

The mounting seat 20 is disposed between the upper shell 11 and the lower shell 12 of the main body 10 and is exposed from the exposing slot 111 of the upper shell 11. The mounting seat 20 has a first end provided with at least one pivot shaft 202 pivotally mounted between the upper shell 11 and the lower shell 12 of the main body 10 and a second end provided with a mounting recess 201 for mounting the hand tool 24. The pivot shaft 202 of the mounting seat 20 is pivotally mounted between the first pivot recess 113 of the upper shell 11 and the second pivot recess 122 of the lower shell 12. The hand tool 24 is preferably a handle, a connecting shank and the like, and is removably mounted on the mounting recess 201 of the mounting seat 20. The mounting seat 20 is provided with at least one positioning stub 203 and a first torsion spring 205. The mounting seat 20 has a side provided with a support shaft 204 for mounting the first torsion spring 205. The first torsion spring 205 is secured on the support shaft 204 and has a distal end abutting the positioning member 21.

The positioning member 21 is disposed between the upper shell 11 and the lower shell 12 of the main body 10 and is movably mounted on the lower shell 12 of the main body 10. The positioning member 21 has a first end provided with at least one pressing piece 214 pressing the oblique push block 141 of the control knob 14 and a second end provided with a second compression spring 23 which is biased between the positioning member 21 and the lower shell 12 of the main body 10. The positioning member 21 has a mediate portion provided with at least one locking hook 212 detachably locked onto the positioning stub 203 of the mounting seat 20. The locking hook 212 of the positioning member 21 is disposed between the pressing piece 214 and the second compression spring 23. The positioning member 21 has a surface provided with a guide slot 213 which extends in an axial direction of the positioning member 21, and a limit member 22 is extended through the guide slot 213 of the positioning member 21 and is secured in the lower shell 12 of the main body 10 to attach the positioning member 21 to the lower shell 12 of the main body 10. The guide slot 213 of the positioning member 21 is slidable axially on the limit member 22. The limit member 22 is preferably a screw member. Thus, the positioning member 21 is limited between the limit member 22 and the lower shell 12 of the main body 10.

The tool holder 30 or 40 is pivotally mounted between the upper shell 11 and the lower shell 12 of the main body 10. The tool holder 30 or 40 has a side provided with a plurality of receiving slots 31 or 41 to allow insertion of the tool heads 5. Each of the tool heads 5 is preferably a screwdriver tip. Each of the tool heads 5 is removably mounted on a respective one of the receiving slots 31 or 41 of the tool holder 30 or 40 and can co-operate with the hand tool 24. The tool holder 30 or 40 has a first end provided with a second torsion spring 32 or 42 and a second end provided with a mounting sleeve 33 or 43 for mounting a push button 34 or 44 and a third compression spring 35 or 45. The second torsion spring 32 or 42 is secured on the tool holder 30 or 40 and is biased between the tool holder 30 or 40 and the lower shell 12 of the main body 10. The push button 34 or 44 is movably mounted between and partially protruded outward from the first limit recess 114 or 115 of the upper shell 11 and the second limit recess 123 or 124 of the lower shell 12. The push button 34 or 44 is provided with at least one locking piece 342 or 442 detachably locked between the first locking groove 1141 or 1151 of the first limit recess 114 or 115 of the upper shell 11 and the second locking groove 1231 or 1241 of the second limit recess 123 or 124 of the lower shell 12. The third compression spring 35 or 45 is biased between the mounting sleeve 33 or 43 of the tool holder 30 or 40 and the push button 34 or 44. The mounting sleeve 33 or 43 of the tool holder 30 or 40 has a periphery provided with a limit slot 331 or 431, the push button 34 or 44 has a periphery provided with a through hole 341 or 441, and at least one limit pin 36 or 46 is extended through the limit slot 331 or 431 of the tool holder 30 or 40 and the through hole 341 or 441 of the push button 34 or 44 to attach the push button 34 or 44 to the mounting sleeve 33 or 43 of the tool holder 30 or 40. The limit pin 36 or 46 is slidable in the limit slot 331 or 431 of the tool holder 30 or 40.

In the preferred embodiment of the present invention, the tool box comprises two tool holders 30 and 40, two second torsion springs 32 and 42, two push buttons 34 and 44, two third compression springs 35 and 45, and two limit pins 36 and 46. The two tool holders 30 and 40 are pivotally mounted on two recessed sides of the main body 10 respectively, and the exposing slot 111 of the upper shell 11 is disposed between the two tool holders 30 and 40. In addition, the mounting seat 20 has two pivot shafts 202 and two positioning stubs 203, and the positioning member 21 has two pressing pieces 214 and two locking hooks 212. In addition, the upper shell 11 of the main body 10 has two first limit recesses 114 and 115 and two first pivot recesses 113, and the lower shell 12 of the main body 10 has two second limit recesses 123 and 124 and two second pivot recesses 122. Each of the two first limit recesses 114 and 115 of the upper shell 11 has two first locking grooves 1141 and 1151. Each of the two second limit recesses 123 and 124 of the lower shell 12 has two second locking grooves 1231 and 1241.

In operation, referring to FIGS. 4 and 5 with reference to FIGS. 1-3, when the control knob 14 is pushed downward, the oblique push block 141 of the control knob 14 is moved downward to push the pressing piece 214 of the positioning member 21 and to move the positioning member 21 so that the positioning member 21 is moved relative to the mounting seat 20, and the locking hook 212 of the positioning member 21 is moved to detach from the positioning stub 203 of the mounting seat 20. At this time, the first compression spring 142 is compressed by the control knob 14 to store its restoring force, and the second compression spring 23 is compressed by the positioning member 21 to store its restoring force. In such a manner, the mounting seat 20 is unlocked from the positioning member 21 and is pushed outward relative to the main body 10 by the elastic force of the first torsion spring 205. Thus, the pivot shaft 202 of the mounting seat 20 is pivoted about the first pivot recess 113 of the upper shell 11 and the second pivot recess 122 of the lower shell 12, and the mounting seat 20 is moved to protrude outward from the exposing slot 111 of the upper shell 11 as shown in FIGS. 4 and 5 so that the hand tool 24 can be easily removed from the mounting recess 201 of the mounting seat 20 for use with a user. At this time, the control knob 14 is pushed by the restoring force of the first compression spring 142 to return to its original position, and the positioning member 21 is pushed by the restoring force of the second compression spring 23 to return to its original position.

On the contrary, when the hand tool 24 is inserted into the mounting recess 201 of the mounting seat 20 after use, the mounting seat 20 is pushed downward to retract into the exposing slot 111 of the upper shell 11, so that the positioning stub 203 of the mounting seat 20 is moved downward to press and pass by the locking hook 212 of the positioning member 21, and the locking hook 212 of the positioning member 21 is hooked onto the positioning stub 203 of the mounting seat 20 to lock the mounting seat 20 onto the positioning member 21.

Referring to FIGS. 6-9 with reference to FIGS. 1-3, when the push button 34 or 44 is pushed toward the tool holder 30 or 40 as shown in FIGS. 7 and 9, the locking piece 342 or 442 of the push button 34 or 44 is moved to detach from the first locking groove 1141 or 1151 of the first limit recess 114 or 115 of the upper shell 11 and the second locking groove 1231 or 1241 of the second limit recess 123 or 124 of the lower shell 12 to unlock the push button 34 or 44 and the tool holder 30 or 40 from the upper shell 11 and the lower shell 12 of the main body 10 so that the push button 34 or 44 is rotatable relative to the main body 10, and the tool holder 30 or 40 is also rotatable relative to the main body 10. At this time, the third compression spring 35 or 45 is compressed by the push button 34 or 44 to store its restoring force. In addition, the limit pin 36 or 46 is driven by the push button 34 or 44 and is moved in the limit slot 331 or 431 of the tool holder 30 or 40. In such a manner, the tool holder 30 or 40 is forced by the elastic force of the second torsion spring 32 or 42 and is rotated outward relative to the main body 10 so that the receiving slots 31 or 41 of the tool holder 30 or 40 is exposed from the main body 10, and the tool heads 5 are protruded outward from the main body 10 as shown in FIG. 4. At this time, the push button 34 or 44 is rotated in concert with the tool holder 30 or 40 by limit of the limit pin 36 or 46. Thus, the tool heads 5 can co-operate with the hand tool 24 for use with the user.

On the contrary, when the tool holder 30 or 40 is rotated in the reverse direction, the push button 34 or 44 is rotated in concert with the tool holder 30 or 40 by limit of the limit pin 36 or 46 and is returned to its original position so that the locking piece 342 or 442 of the push button 34 or 44 is moved to align with the first locking groove 1141 or 1151 of the first limit recess 114 or 115 of the upper shell 11 and the second locking groove 1231 or 1241 of the second limit recess 123 or 124 of the lower shell 12. At this time, the second torsion spring 32 or 42 is distorted by rotation of the tool holder 30 or 40 to store its restoring force. Then, the push button 34 or 44 is pushed outward relative to the tool holder 30 or 40 by the restoring force of the third compression spring 35 or 45 as shown in FIGS. 6 and 8, and the locking piece 342 or 442 of the push button 34 or 44 is moved into and locked in the first locking groove 1141 or 1151 of the first limit recess 114 or 115 of the upper shell 11 and the second locking groove 1231 or 1241 of the second limit recess 123 or 124 of the lower shell 12 to lock the push button 34 or 44 between the upper shell 11 and the lower shell 12 of the main body 10 and to position the tool holder 30 or 40 in place.

Accordingly, the mounting seat 20 and the tool holder 30 or 40 can be pivoted outward automatically to expose the hand tool 24 and the tool heads 5 respectively so that the tool heads 5 can co-operate with the hand tool 24 for use with the user. In addition, the user only needs to press the control knob 14 and the push button 34 or 44 to pivot the mounting seat 20 and the tool holder 30 or 40 respectively so that the mounting seat 20 and the tool holder 30 or 40 can be opened easily and quickly, thereby facilitating the user operating the tool box.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

The invention claimed is:

1. A tool box comprising:

a main body;

a mounting seat pivotally mounted on the main body for mounting a hand tool;

a positioning member movably mounted in the main body and releasably locked onto the mounting seat; and at least one tool holder pivotally mounted on the main body for mounting a plurality of tool heads, wherein:

the main body includes an upper shell and a lower shell combined with the upper shell;

the upper shell of the main body has a surface provided with an exposing slot;

the upper shell of the main body has a mounting hole for mounting a control knob and a first compression spring;

the control knob is movably mounted in the mounting hole of the upper shell and has an upper end protruding outward from the mounting hole of the upper shell and a lower end provided with an oblique push block;

the upper shell of the main body has a side provided with at least one first limit recess which has at least one first locking groove;

the lower shell of the main body has a side provided with at least one second limit recess which has at least one second locking groove;

the mounting seat has a first end provided with at least one pivot shaft pivotally mounted between the upper shell and the lower shell of the main body and a second end provided with a mounting recess for mounting the hand tool;

the mounting seat is provided with at least one positioning stub and a first torsion spring;

the positioning member has a first end provided with at least one pressing piece pressing the oblique push block of the control knob and a second end provided with a second compression spring which is biased between the positioning member and the lower shell of the main body;

the positioning member has a mediate portion provided with at least one locking hook detachably locked onto the positioning stub of the mounting seat;

the tool holder has a side provided with a plurality of receiving slots to allow insertion of the tool heads;

the tool holder has a first end provided with a second torsion spring and a second end provided with a mounting sleeve for mounting a push button and a third compression spring;

the push button is provided with at least one locking piece detachably locked between the first locking groove of the first limit recess of the upper shell and the second locking groove of the second limit recess of the lower shell;

the lower shell of the main body has a surface provided with a mounting tube for mounting the first compression spring; and the first compression spring is biased between the oblique push block of the control knob and the lower shell of the main body.

2. A tool box comprising:

a main body;

a mounting seat pivotally mounted on the main body for mounting a hand tool;

a positioning member movably mounted in the main body and releasably locked onto the mounting seat; and at least one tool holder pivotally mounted on the main body for mounting a plurality of tool heads, wherein:

the main body includes an upper shell and a lower shell combined with the upper shell;

the upper shell of the main body has a surface provided with an exposing slot;

the upper shell of the main body has a mounting hole for mounting a control knob and a first compression spring;

the control knob is movably mounted in the mounting hole of the upper shell and has an upper end protruding outward from the mounting hole of the upper shell and a lower end provided with an oblique push block;

the upper shell of the main body has a side provided with at least one first limit recess which has at least one first locking groove;

the lower shell of the main body has a side provided with at least one second limit recess which has at least one second locking groove;

the mounting seat has a first end provided with at least one pivot shaft pivotally mounted between the upper shell and the lower shell of the main body and a second end provided with a mounting recess for mounting the hand tool;

the mounting seat is provided with at least one positioning stub and a first torsion spring;

the positioning member has a first end provided with at least one pressing piece pressing the oblique push block of the control knob and a second end provided with a second compression spring which is biased between the positioning member and the lower shell of the main body;

the positioning member has a mediate portion provided with at least one locking hook detachably locked onto the positioning stub of the mounting seat;

the tool holder has a side provided with a plurality of receiving slots to allow insertion of the tool heads;

the tool holder has a first end provided with a second torsion spring and a second end provided with a mounting sleeve for mounting a push button and a third compression spring;

the push button is provided with at least one locking piece detachably locked between the first locking groove of the first limit recess of the upper shell and the second locking groove of the second limit recess of the lower shell;

the upper shell of the main body has an edge provided with at least one first pivot recess;

the lower shell of the main body has an edge provided with at least one second pivot recess; and the pivot shaft of the mounting seat is pivotally mounted between the first pivot recess of the upper shell and the second pivot recess of the lower shell.

3. A tool box comprising:

a main body;

a mounting seat pivotally mounted on the main body for mounting a hand tool;

a positioning member movably mounted in the main body and releasably locked onto the mounting seat; and at least one tool holder pivotally mounted on the main body for mounting a plurality of tool heads, wherein:

the main body includes an upper shell and a lower shell combined with the upper shell;

the upper shell of the main body has a surface provided with an exposing slot;

the upper shell of the main body has a mounting hole for mounting a control knob and a first compression spring;

the control knob is movably mounted in the mounting hole of the upper shell and has an upper end protruding outward from the mounting hole of the upper shell and a lower end provided with an oblique push block;

the upper shell of the main body has a side provided with at least one first limit recess which has at least one first locking groove;

the lower shell of the main body has a side provided with at least one second limit recess which has at least one second locking groove;

the mounting seat has a first end provided with at least one pivot shaft pivotally mounted between the upper shell and the lower shell of the main body and a second end provided with a mounting recess for mounting the hand tool;

the mounting seat is provided with at least one positioning stub and a first torsion spring;

the positioning member has a first end provided with at least one pressing piece pressing the oblique push block of the control knob and a second end provided with a second compression spring which is biased between the positioning member and the lower shell of the main body;

the positioning member has a mediate portion provided with at least one locking hook detachably locked onto the positioning stub of the mounting seat;

the tool holder has a side provided with a plurality of receiving slots to allow insertion of the tool heads;

the tool holder has a first end provided with a second torsion spring and a second end provided with a mounting sleeve for mounting a push button and a third compression spring;

the push button is provided with at least one locking piece detachably locked between the first locking groove of the first limit recess of the upper shell and the second locking groove of the second limit recess of the lower shell;

the mounting seat has a side provided with a support shaft for mounting the first torsion spring;

the first torsion spring is secured on the support shaft and has a distal end abutting the positioning member; and the mounting seat is disposed between the upper shell and the lower shell of the main body and is exposed from the exposing slot of the upper shell.

4. The tool box of claim 2, wherein:

the positioning member has a surface provided with a guide slot which extends in an axial direction of the positioning member;

the tool box further comprises a limit member extended through the guide slot of the positioning member and secured in the lower shell of the main body to attach the positioning member to the lower shell of the main body;

the guide slot of the positioning member is slidable axially on the limit member;

the limit member is a screw member;

the positioning member is disposed between the upper shell and the lower shell of the main body and is movably mounted on the lower shell of the main body; and the positioning member is limited between the limit member and the lower shell of the main body.

5. The tool box of claim 2, wherein:

the mounting sleeve of the tool holder has a periphery provided with a limit slot;

the push button has a periphery provided with a through hole;

the tool box further comprises at least one limit pin extended through the limit slot of the tool holder and the through hole of the push button to attach the push button to the mounting sleeve of the tool holder;

the limit pin is slidable in the limit slot of the tool holder;

the tool holder is pivotally mounted between the upper shell and the lower shell of the main body;

the second torsion spring is secured on the tool holder and is biased between the tool holder and the lower shell of the main body;

the push button is movably mounted between and partially protruded outward from the first limit recess of the upper shell and the second limit recess of the lower shell; and the third compression spring is biased between the mounting sleeve of the tool holder and the push button.

6. The tool box of claim 2, wherein the tool box comprises two tool holders.

7. The tool box of claim 6, wherein:

the two tool holders are pivotally mounted on two recessed sides of the main body respectively; and the exposing slot of the upper shell is disposed between the two tool holders.

* * * * *